US007317454B2

(12) United States Patent
Choi

(10) Patent No.: US 7,317,454 B2
(45) Date of Patent: Jan. 8, 2008

(54) ENERGY RECOVERY CIRCUIT OF DISPLAY DEVICE

(75) Inventor: Jeong Pil Choi, Kyonggi-do (KR)

(73) Assignee: LG Electronics, Inc., Seoul (KR)

( * ) Notice: Subject to any disclaimer, the term of this patent is extended or adjusted under 35 U.S.C. 154(b) by 446 days.

(21) Appl. No.: 10/214,328

(22) Filed: Aug. 8, 2002

(65) Prior Publication Data

US 2003/0030632 A1 Feb. 13, 2003

(30) Foreign Application Priority Data

Aug. 8, 2001 (KR) ..... 10-2001-0047706
Dec. 4, 2001 (KR) ..... 10-2001-0076378

(51) Int. Cl.
*G09G 5/00* (2006.01)

(52) U.S. Cl. ..... 345/211; 345/60

(58) Field of Classification Search ..... 345/165, 345/204, 211, 60–71; 315/165, 169.1, 169.4
See application file for complete search history.

(56) References Cited

U.S. PATENT DOCUMENTS 4,866,349 A * 9/1989 Weber et al. ..... 315/169.4
5,670,974 A * 9/1997 Ohba et al. ..... 345/60
5,717,437 A * 2/1998 Sano et al. ..... 345/211
5,828,353 A * 10/1998 Kishi et al. ..... 345/55
6,538,627 B1 * 3/2003 Whang et al. ..... 345/60
6,633,285 B1 * 10/2003 Kigo et al. ..... 345/204
6,674,417 B2 * 1/2004 Hsu et al. ..... 345/60
6,686,912 B1 * 2/2004 Kishi et al. ..... 345/211
2001/0030645 A1 * 10/2001 Tsutsui et al. ..... 345/211

FOREIGN PATENT DOCUMENTS

JP 2002156941 A * 5/2002

* cited by examiner

*Primary Examiner*—Regina Liang
(74) *Attorney, Agent, or Firm*—Birch, Stewart, Kolasch & Birch, LLP

(57) ABSTRACT

An energy recovery circuit of a display device, which provides a driving voltage to a display panel, is disclosed. The energy recovery circuit includes a first capacitor for charging the voltage recovered from the display panel, a switch circuit connected between the first capacitor and the display panel and having a plurality of switches for switching a current flow when charging/discharging the first capacitor and the display panel, a second capacitor connected between the switches of the switch circuit for discharging the charged voltage to the display panel along with the voltage discharged from the first capacitor when charging the display panel, and a power supply for providing voltage to the first and second capacitors.

25 Claims, 11 Drawing Sheets

ENERGY RECOVERY CIRCUIT OF DISPLAY DEVICE

This application claims the benefit of the Korean Patent Application Nos. P 2001-76378 and P 2001-47706 filed on Dec. 4, 2001 and on Aug. 8, 2001 respectively, which are hereby incorporated by reference.

BACKGROUND OF THE INVENTION

1. Field of the Invention

The present invention relates to a display device, and more particularly, to an energy recovery circuit of a display device, which provides a driving voltage to a display panel.

2. Discussion of the Prior Art

Among various display devices, a plasma display panel (PDP) is a display device using a gas discharge technology. The PDP can be divided into two types, i.e., an alternating current type and a direct current type. The PDP of the direct current type uses the surface discharge which occurs on the surface of a dielectric substance when an electrode is coated with a dielectric substance.

In the PDP of the direct current type, great losses of the power occur because of a driving pulse with a high frequency and any charge/discharge caused by a high driving voltage. In order to minimize this power loss, an energy recovery circuit is additionally provided to a driving circuit of the PDP.

The energy recovery circuit reuses the ineffectual energy as a driving voltage for a next discharging stage, by recovering the energy which is ineffectually generated in the display panel(i.e., ineffectual energy).

FIG. 1 is a diagram illustrating a typical energy recovery circuit in accordance with the prior art. As shown in FIG. 1, the energy recovery circuit of the prior art includes first and third switches S1 and S3 connected to an energy recovery capacitor Cs in parallel, a second switch S2 for providing a sustain voltage Vs to a display panel, and a fourth switch S4 for providing a ground voltage(GND) to the display panel.

The method of driving the energy recovery circuit of the prior art shown in FIG. 1 will be described below.

First, the first switch S1 is turned on to provide the voltage charged in the energy recovery capacitor Cs to a display panel, and a second switch S2 is turned on to provide the sustain voltage Vs to the display panel as well.

Then, the third switch S3 is turned on to recharge the energy recovery capacitor Cs with a portion of the voltage provided to the display panel. Lastly, a fourth switch S4 is turned on to ground the voltage of the display panel.

The energy recovery circuit of the prior art, however has the following disadvantages. In the energy recovery circuit of the prior art, power consumption increases because of a high voltage (Vs) required for maintaining the display panel to a sustain voltage level.

Also, because the switch devices suitable for such high voltage are required in the prior art, a cost for producing the circuit is extremely high.

SUMMARY OF THE INVENTION

Accordingly, the present invention is directed to an energy recovery circuit of a display device that substantially obviates one or more problems due to limitations and disadvantages of the prior art.

An object of the present invention is to provide an energy recovery circuit of a display device with low power consumption, while being able to be produced with low cost.

Another object of the present invention is to provide an energy recovery circuit of a display device, which stabilizes a driving wave for a stable sustain discharge.

To achieve these objects and other advantages and in accordance with the purpose of the invention, as embodied and broadly described herein, an energy recovery circuit of a display device in accordance of the present invention includes a first capacitor, a switch circuit, a second capacitor, and a power supply. The first capacitor charges a voltage recovered from the display panel. The switch circuit is connected between the first capacitor and the display panel and has a plurality of switches for switching current flows when charge/discharge the first capacitor and the display panel. The second capacitor is connected between switches of the switch circuit and discharges the charged voltage to the display panel along with the voltage discharged from the first capacitor when charging the display panel. The power supply provides voltage to the first and second capacitors.

The voltage being charged in the first and second capacitors is a half of the voltage charged in the display panel. Either a diode or a switch device may be connected between the first capacitor and the power supply.

The switch circuit includes first, second, third and fourth switches, a second capacitor, and an inductor. The first and third switches are connected to the first capacitor in parallel and also connected to each other serially. The second capacitor is connected to the first switch in parallel. The inductor is connected to at least one of the first and third switches and also connected to the display panel serially to form an LC resonance circuit. The second and fourth switches are connected to a node between the display panel and the inductor.

In another aspect of the present invention, an energy recovery circuit providing a driving voltage to a display panel includes a power supply, first and second capacitors, first, second, third, and fourth switches, and an inductor. The power supply is for providing a voltage. The first capacitor connected to the power supply charges a voltage recovered from the display panel. The first switch connected to a first node between the power supply and the first capacitor switches a voltage provided from the first capacitor to the display panel. The third switch connected to the first switch and the first node switches a voltage provided from the display panel to the first capacitor. The inductor is serially connected between the display panel and a second node between the first and second switches to form an LC resonance circuit. The second switch connected between the first switch and a third node between the display panel and the inductor switches the voltage provided from the first capacitor to the display panel. The second capacitor connected between a fourth node(between the first switch and the second switch) and a fifth node(between the first switch and the inductor) provides a voltage to the display panel along with the voltage discharged from the first capacitor when charging the display panel. The fourth switch connected to the third node switches the voltage discharged from the display panel so as to ground it.

At this time, a fifth switch is connected between the first node and the power supply. A first diode is connected between the fifth and second nodes and a second diode is connected between the second node and the third switch. A third node is connected between the first switch and the fourth node. A fourth diode is connected between the power supply and the first node.

The energy recovery circuit of a display device of the present invention may further comprise a sixth switch with one end connected to the second capacitor and the other end grounded.

In a further another aspect of the present invention, an energy recovery circuit providing a driving voltage to a display panel includes a power supply, first and second capacitors, first and second inductors, and first, second, third, and fourth switches. The power supply is for providing a voltage. The first capacitor connected to the power supply charges a voltage recovered from the display panel. The first switch connected to a first node between the power supply and the first capacitor switches a voltage provided from the first capacitor to the display panel. The third switch connected to the first node switches a voltage provided from the display panel to the first capacitor. The first inductor is serially connected between the third switch and the display panel to form a first LC resonance circuit. The second inductor is serially connected between the first switch and the display panel to form a second LC resonance circuit. The second switch connected between the first node and a second node between the second inductor and the display panel switches the voltage provided from the first capacitor to the display panel. The second capacitor connected between a fourth node (between the first node and the second switch) and a fifth node(between the fourth node and the first switch) provides a voltage to the display panel along with the voltage discharged from the first capacitor when charging the display panel. The fourth switch connected to a third node between the first inductor and the display panel switches the voltage discharged from the display panel so as to ground it.

At this time, the inductance values of the first and second inductors are different from each other.

The inductance value of the first inductor is larger than that of the second inductor.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the embodiments of the present invention, examples of which are illustrated in the accompanying drawings. Wherever possible, the same reference numbers will be used throughout the drawings to refer to the same or like parts.

An energy recovery circuit of the present invention includes first and second capacitors, a switch circuit, and a power supply. The first capacitor is connected to the power supply and charges a voltage(sustain voltage (Vs)/2) recovered from the display panel. The second capacitor is connected between switches of the switch circuit and discharges the charged voltage(voltage Vs/2) to the display panel along with a voltage(voltage Vs/2) discharged from the first capacitor.

The switch circuit connected between the first capacitor and the display panel has a plurality of switches for switching current flows when charging/discharging the first capacitor and the display panel.

First Embodiment

Figure 1:
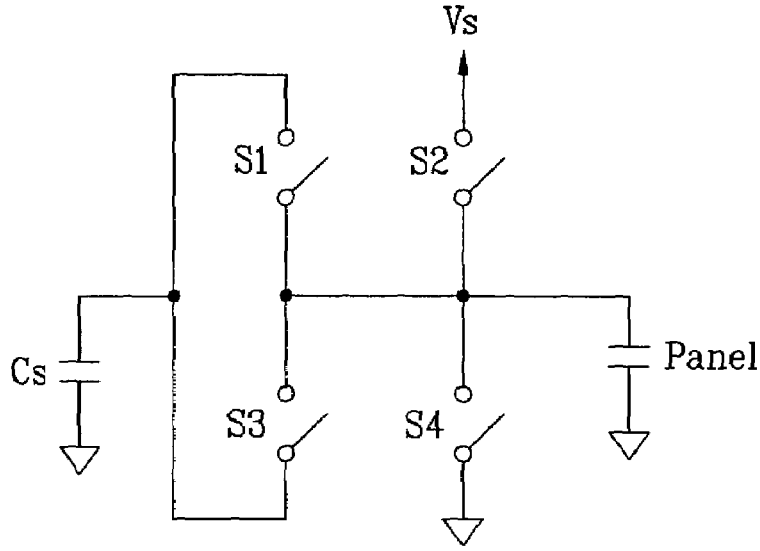
FIG. 1 Prior Art
FIG. 1 is a circuit diagram illustrating an energy recovery circuit of the prior art.
Figure 2A:
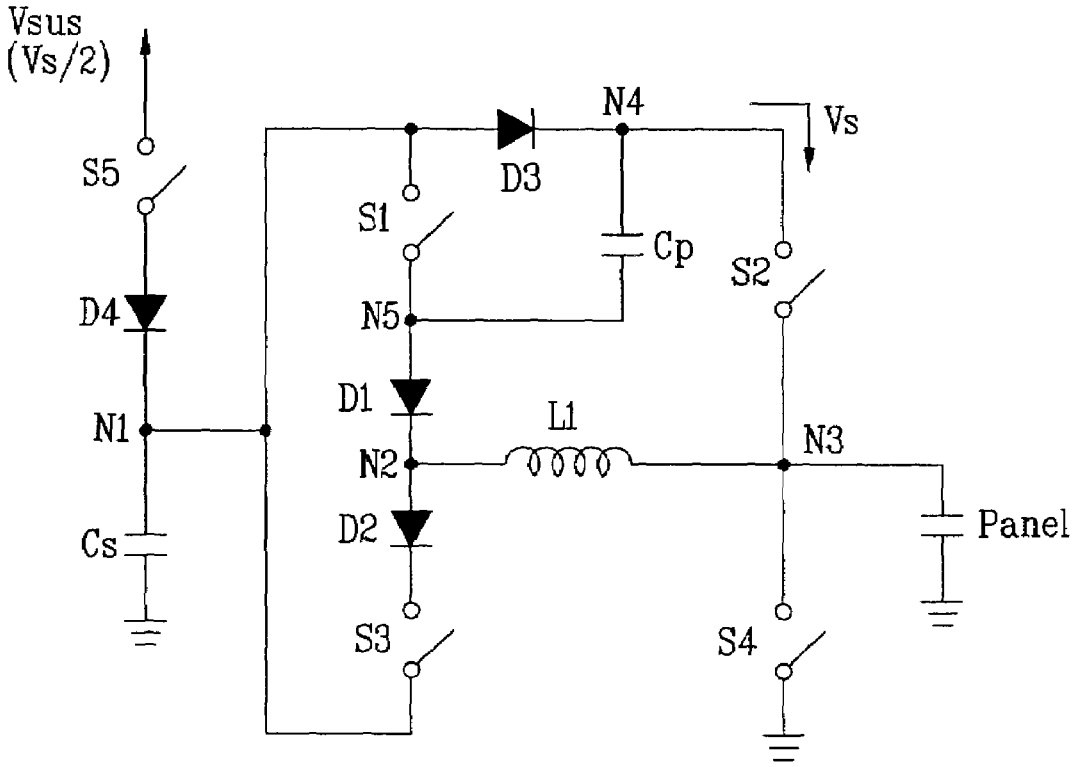
FIG. 2A is a circuit diagram illustrating an energy recovery circuit in accordance with the first embodiment of the present invention.
Figure 2B:
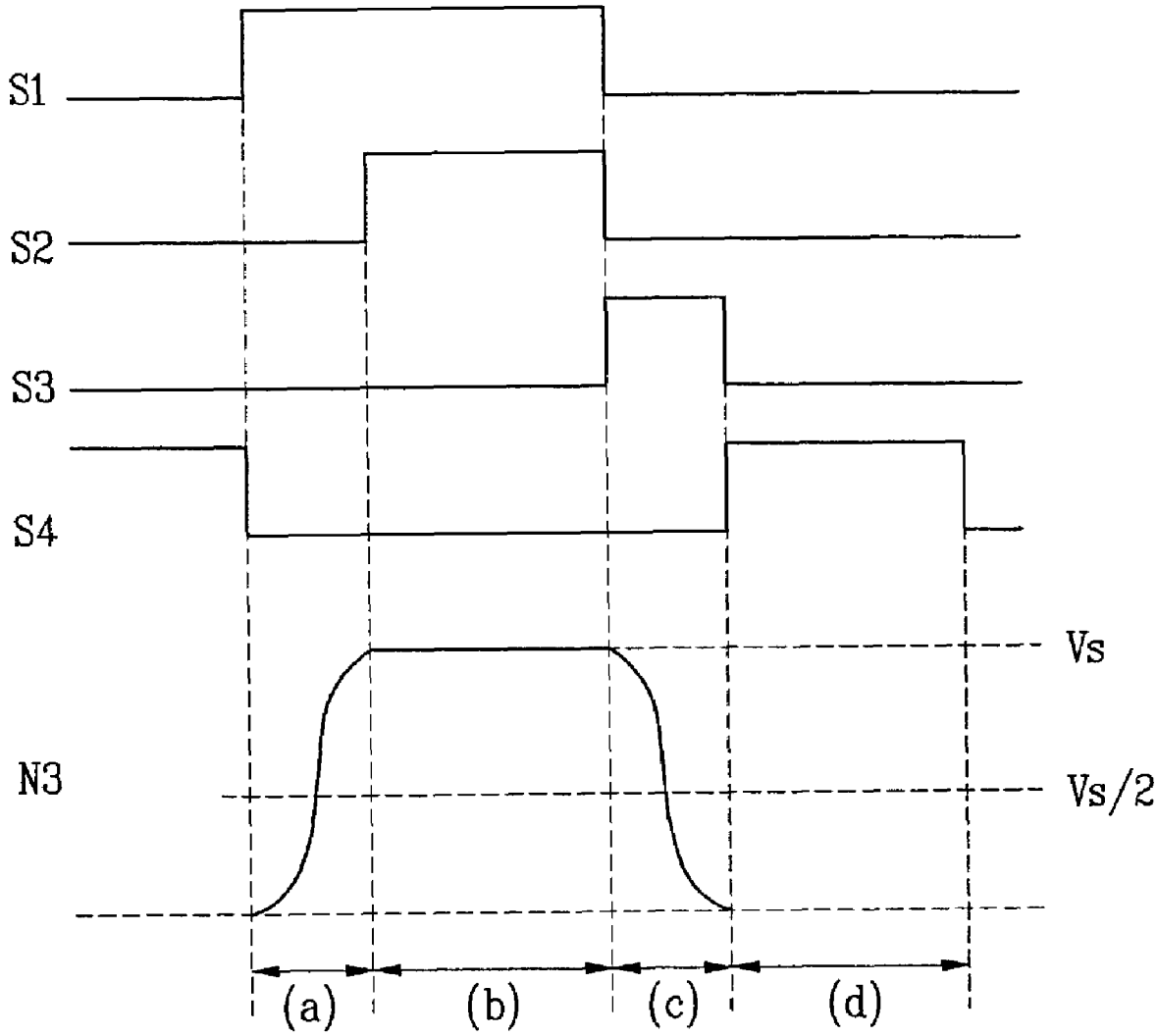
FIG. 2B is a driving waveform illustrating the energy recovery circuit of FIG. 2A.

FIG. 2A is a circuit diagram illustrating an energy recovery circuit in accordance with the first embodiment of the present invention. FIG. 2B is a driving waveform of the energy recovery circuit of FIG. 2A.

As shown in FIG. 2A, the first embodiment of the present invention includes a power supply Vsus, an inductor L1, first and second capacitors Cs and Cp, and first, second, third, and fourth switches S1, S2, S3, and S4. The power supply Vsus provides a half of a sustain voltage (Vs/2). The first capacitor Cs is connected to the power supply Vsus and a ground. The first switch S1 is connected to a first node N1 between the power supply Vsus and the first capacitor Cs. The third switch S3 is connected to the first switch S1 and the first node N1. The inductor L1 is serially connected between the display panel and a second node N2 between the first and third switches S1 and S3. The second switch S2 is connected between the first switch Si and a third node N3 between the display panel and the inductor L1. The second capacitor Cp is connected between a fourth node N4 (between the first and second switches S1 and S2) and a fifth node N5 (between the first switch S1 and the inductor L1). The fourth switch S4 is connected to the third node N3 and the ground.

When discharging the display panel, the first capacitor Cs recovers a voltage from the display panel so as to charge it, and when charging the display panel, the first capacitor Cs discharges the charged voltage so as to provide that voltage to the display panel.

On the other hand, when charging the display panel, the second capacitor Cp provides the charged voltage to the display panel, along with the voltage discharged from the first capacitor Cs.

In other words, the first and second capacitors Cs and Cp are respectively charged with a half of the sustain voltage (Vs/2). The voltage Vs/2 of the first capacitor Cs and the voltage Vs/2 of the second capacitor Cp are added up, thereby making the sustain voltage Vs when charging the display panel. The sustain voltage Vs is provided to the display panel.

More detailed explanation on this matter will be described later.

A fifth switch may be connected between the first node N1 and the power supply Vsus.

Also, a first diode D1 may be connected between the fifth and second nodes N5 and N2, a second diode D2 may be connected between the second node N2 and third switch S3, a third diode D3 may be connected between the first switch S1 and the fourth node N4, and a fourth diode D4 may be connected between the power supply Vsus and the first node N1.

The first, third, and fourth diodes D1, D3, and D4 pass a current flow from the first capacitor Cs to the display panel, and the second diode D2 passes a current flow from the display device to the first capacitor Cs.

The first capacitor Cs, the fourth switch S4, and one end of the display panel are grounded.

The first to fifth switches S1 to S5 are materialized as a semiconductor switch device such as MOS, FET, IGBT, and BJT.

As shown in FIG. 2B, the voltage charged in the display before the period (a) is assumed to be zero.

Also, the first capacitor Cs for recovering energy and the second capacitor Cp are respectively charged with the half of the sustain voltages (Vs/2) by the fifth switch S5.

In the period (a), all the switches except for the first switch S1, which is turned on, are turned off.

The first switch Si is turned on in the period (a) thereby forming a current path going through the first capacitor Cs, the first switch Si, the inductor L1, and the display panel in order.

Especially, the inductor L1 and the display panel form a serial resonance circuit.

As the first capacitor Cs and the second capacitor Cp are respectively charged with the half of the sustain voltage (Vs/2), the voltage of the display panel increases up to the sustain voltage Vs, the voltage of the first and second capacitors Cs and Cp, by charging/discharging the current of the inductor L1 in the serial resonance circuit.

Accordingly, the driving voltage provided from the outside is minimized to the half of the sustain voltage Vs/2 because the voltage of the display panel was increased to the sustain voltage Vs in the period (a).

In the period (b), the second switch S2 is turned on. When the second switch is turned on, the sustain voltage Vs is provided to the display panel. The sustain voltage Vs provided to the display panel prevents the voltage of the display panel from being decreased to the sustain voltage Vs level or less than it so that the sustain discharge occurs in a normal condition.

In the period (c), the third switch S3 is turned on.

At this time, a current path going through the display panel, the inductor L1, the third switch S3, and the first capacitor Cs is formed in order, and thus the voltage charged in the display panel is recovered to the first capacitor Cs, which is for recovering energy.

After the half of the sustain voltage (Vs/2) is charged in the first capacitor Cs, the third and fourth switches S3 and S4 are turned on.

In the period (d), in which the fourth switch S4 is turned on, a current path from the display panel to a ground voltage source GND is formed and the voltage of the display panel is decreased to zero volt.

Then, the half of the sustain voltage (Vs/2) from the power supply Vsus is charged in the second capacitor Cp as the fourth and fifth switches S4 and S5 are turned on.

Accordingly, in the period (d), the first capacitor Cs for recovering energy and the second capacitor Cp are respectively charged with the half of the sustain voltage (Vs/2).

An alternating current driving pulse provided to the display panel is obtained as the operating process of the periods (a) to (d) is periodically repeated.

Figure 3:
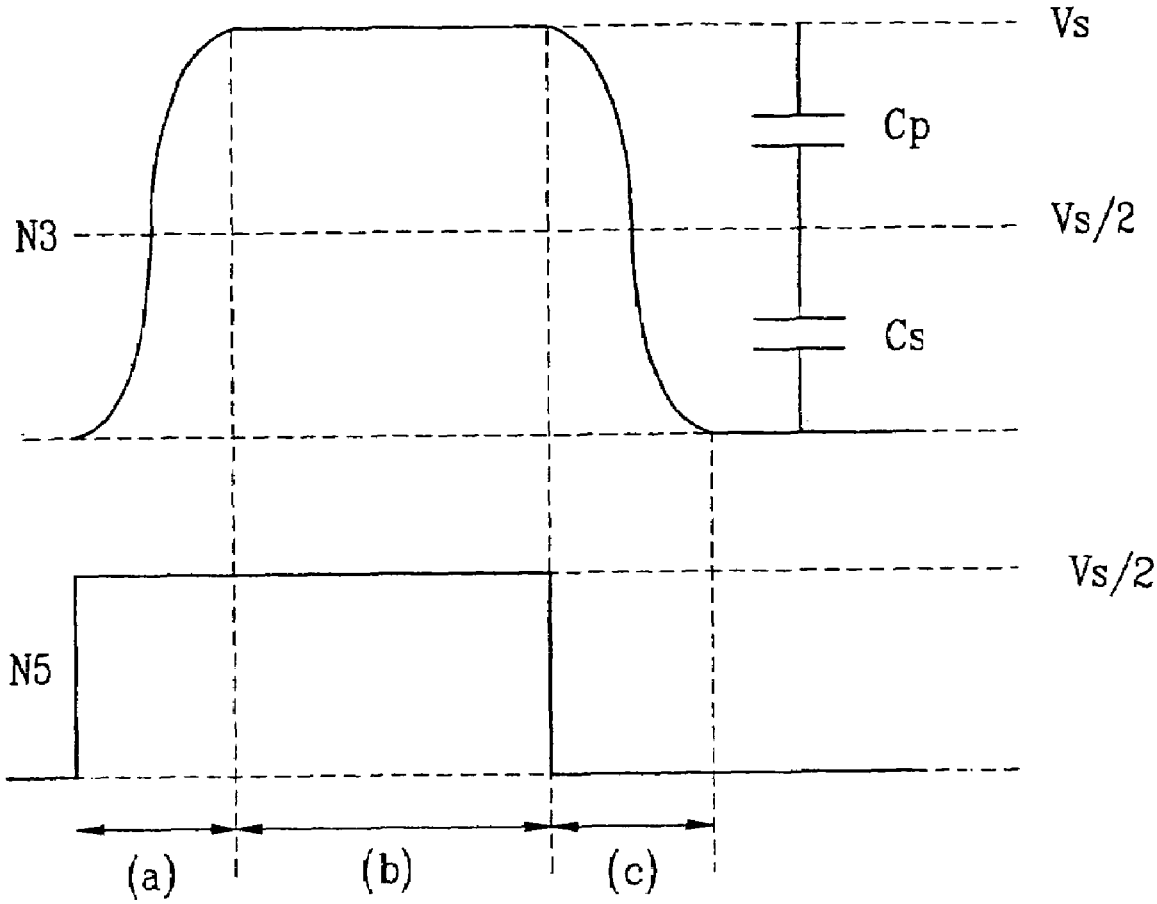
FIG. 3 is a waveform illustrating the voltage of the third and fifth nodes N3 and N5 in FIG. 2A.

FIG. 3 shows waveforms illustrating the voltage of the third and fifth nodes N3 and N5 shown in FIG. 2A.

As shown in FIG. 3, one important feature of the energy recovery circuit of the present invention is that the intended sustain voltage Vs is obtained by using the half of the sustain voltage (Vs/2).

First, as described above, the first capacitor Cs and the second capacitor Cp are respectively charged with the half of the sustain voltage (Vs/2).

Then, in the operation of the period (a) shown in FIG. 3, a resonance wave increasing from the half of the sustain voltage (Vs/2) to the sustain voltage Vs occurs on the third node N3.

On the fifth node N5, the half of the sustain voltage Vs/2 is maintained as the first switch S1 is turned on.

On the third node N3, the resonance pulse increases to have more than the half of the sustain voltage Vs/2 by the LD resonance circuit. However, the half of the sustain voltage Vs/2 is maintained because of the first diode D1.

Thus, the intended Vs voltage is obtained by adding the Vs/2 voltage of the fifth node N5 and the Vs/2 voltage charged in the fourth node N4, a "+" terminal of the second capacitor Cp(Vs/2+Vs/2=Vs).

When the second switch S2 is turned on in the period (b), the voltage Vs obtained in the period (a) is provided to the display panel through the third node N3.

At this instance, the half of the sustain voltage Vs/2 should be provided to the fifth node N5 while a maintaining pulse having the sustain voltage Vs of the period (b) is maintained as the second switch S2 is turned on.

Therefore, the first switch S1 of the period (a) should be maintained for a long time such that the sustain discharge fully occurs.

Generally, the first switch S1 is controlled to be turned off at the same time as the second switch S2 is turned off.

Second Embodiment

Figure 4A:
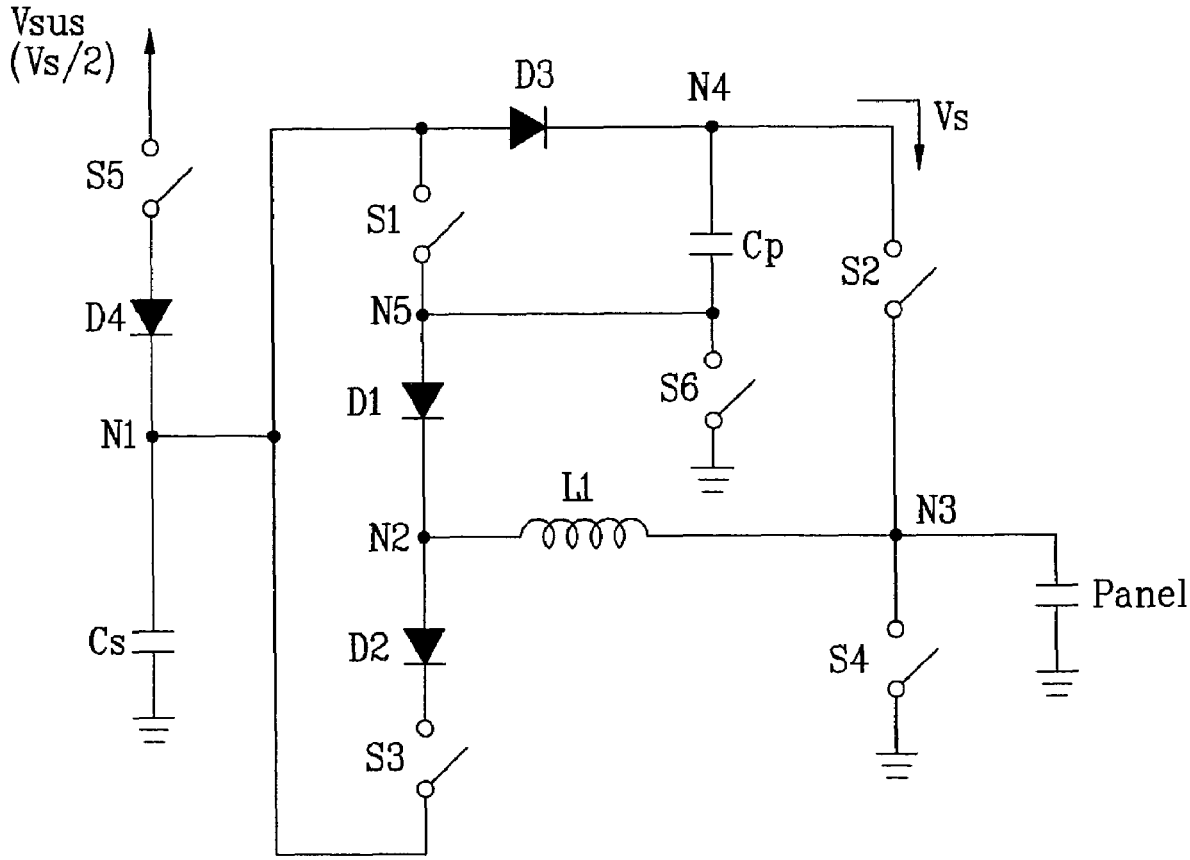
FIG. 4A is a circuit diagram illustrating an energy recovery circuit in accordance with the second embodiment of the present invention.
Figure 4B:
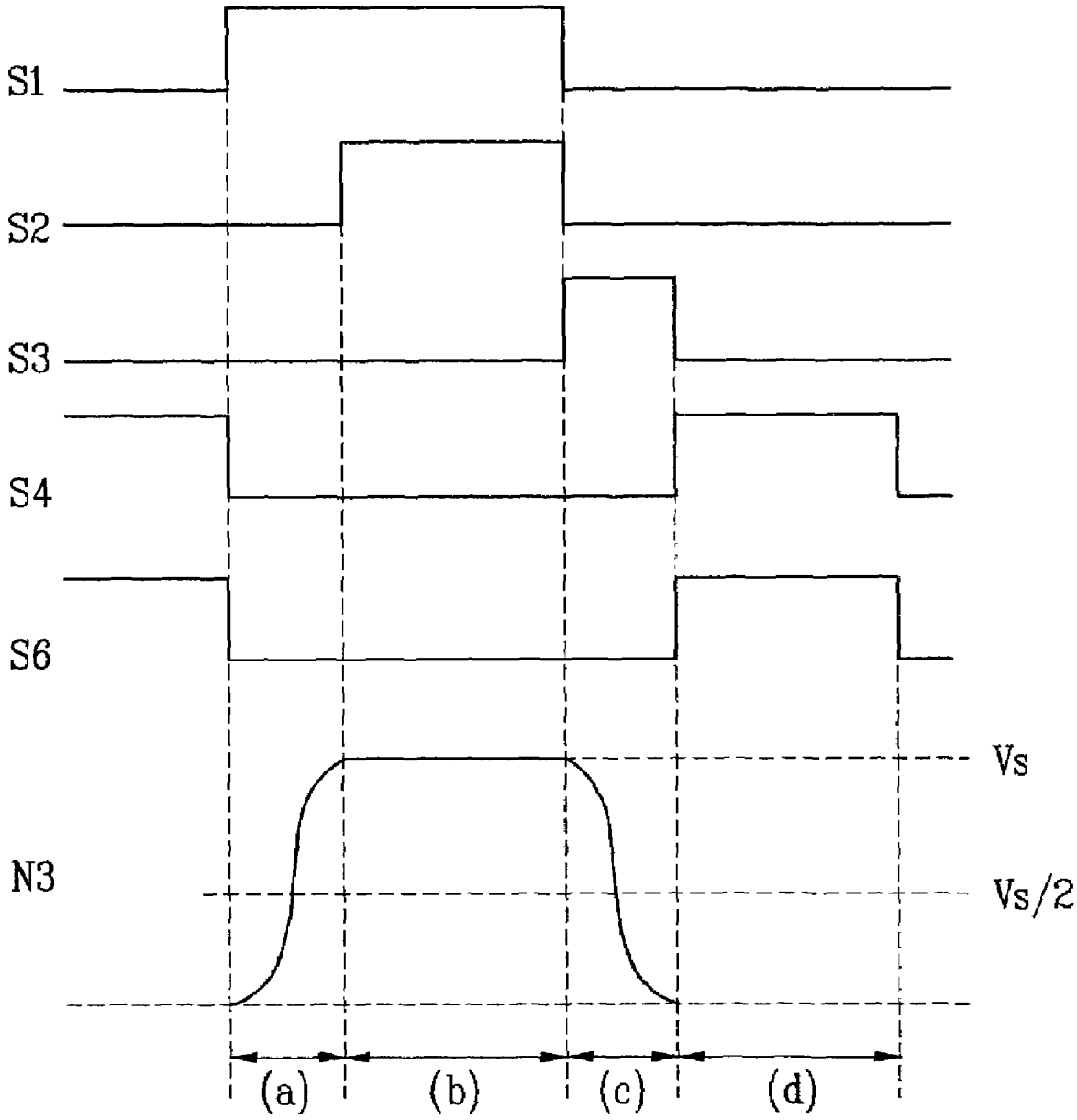
FIG. 4B is a driving waveform illustrating the energy recovery circuit of FIG. 4A.

FIG. 4A is a circuit diagram illustrating an energy recovery circuit in accordance with the second embodiment of the present invention. FIG. 4B is a driving waveform of the energy recovery circuit of FIG. 4A.

In the second embodiment of the present invention, a sixth switch S6 is additionally provided to the same construction as the first embodiment.

The half of the sustain voltage (Vs/2) is charged in a second capacitor Cp when a fourth switch S4 is turned on.

At this time, the operation of a circuit can become unstable because a ground path temporarily forms an LD resonance circuit when an inductor L1 on the ground path is being passed through.

Therefore, in the second embodiment, the sixth switch S6 with one end connected to the second capacitor Cp and the other end grounded is additionally provided.

The sixth switch S6 makes it possible for the second capacitor Cp to a charge voltage in a stable condition.

Though the operation time of the sixth switch S6 is same as that of the fourth switch S4, it can make the charging operation of the second capacitor Cp more stable by using the period (c) shown in FIG. 4B in driving itself.

Third Embodiment

Figure 5A:
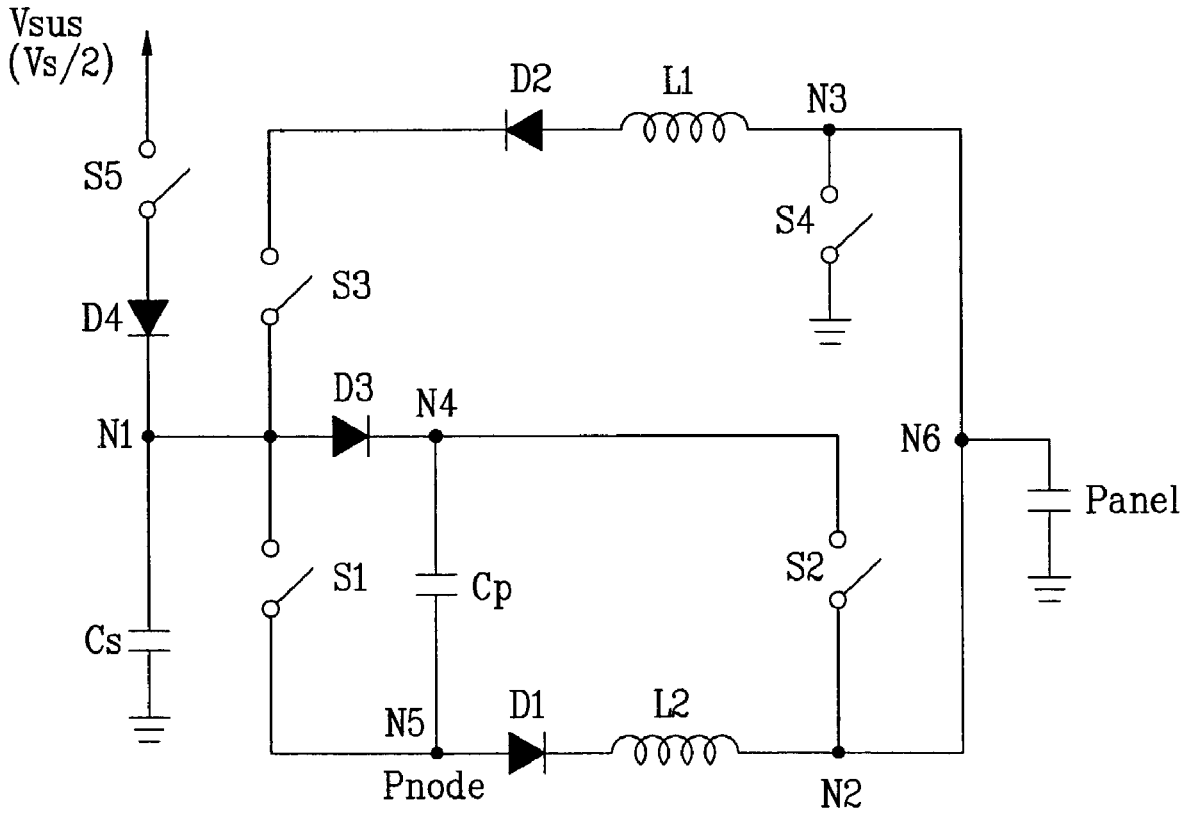
FIG. 5A is a circuit diagram illustrating an energy recovery circuit in accordance with the third embodiment of the present invention.
Figure 5B:
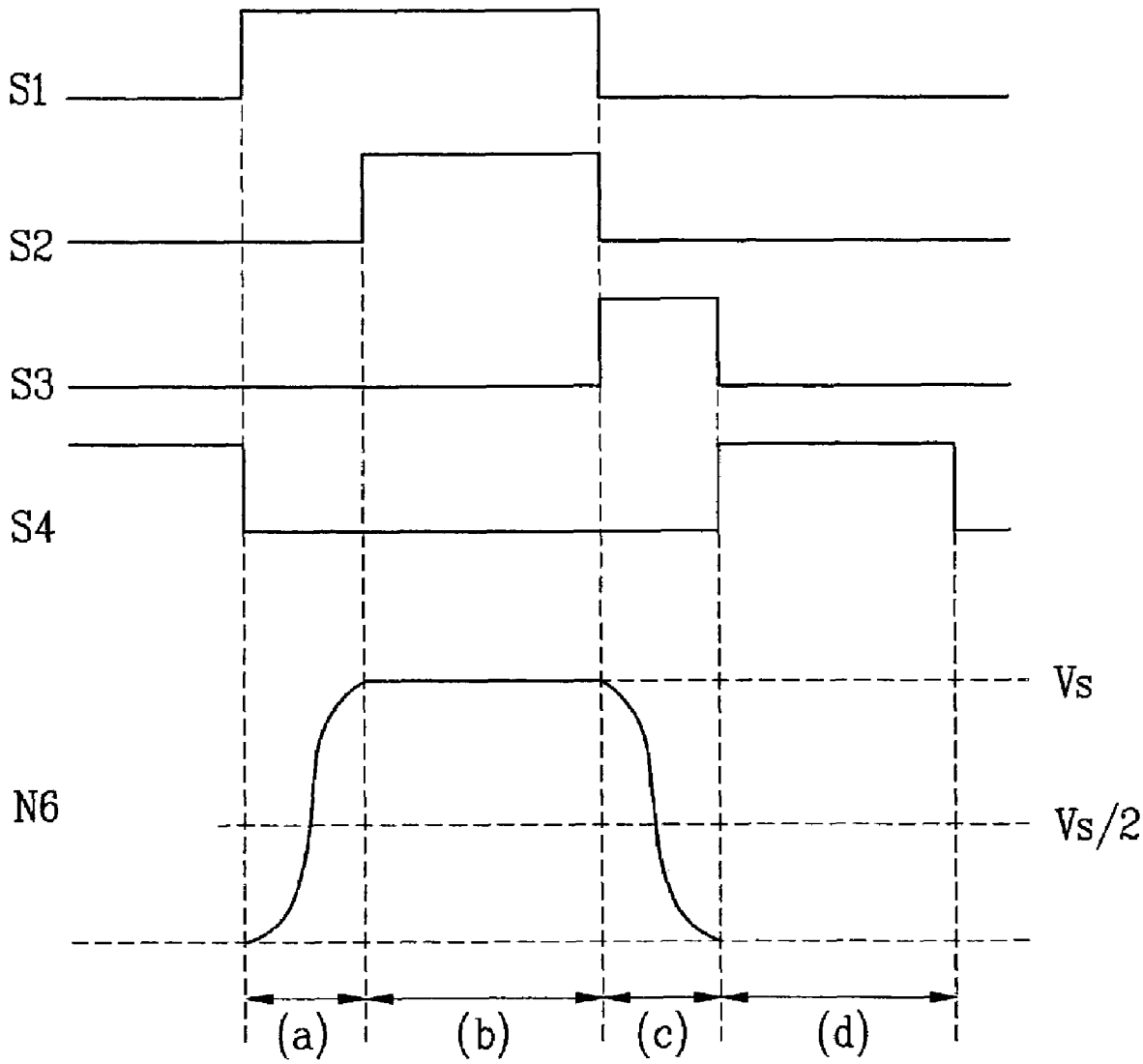
FIG. 5B is a driving waveform illustrating the energy recovery circuit of FIG. 5A.

FIG. 5A is a circuit diagram illustrating an energy recovery circuit in accordance with the third embodiment of the present invention. FIG. 5B is a driving waveform of the energy recovery circuit of FIG. 5A.

As shown in FIG. 5A, the third embodiment of the present invention includes a power supply Vsus, first and second capacitors Cs and Cp, first and second inductors L1 and L2, first, second, third, and fourth switches S1 to S4. The power supply Vsus provides a sustain voltage Vs/2. The first capacitor Cs is connected to the power supply Vsus and a ground. The first and third switches are connected to a first node N1. The first inductor L1 is serially connected between the third switch S3 and a display panel to form a first LC resonance circuit. The second inductor L2 is serially connected between the first switch S1 and the display panel to form a second LC resonance circuit. The second switch S2 is connected between first and second nodes N1 and N2. The second capacitor Cp is connected to fourth and fifth nodes N4 and N5. The fourth switch S4 is connected to the third node and the ground.

At this instance, the inductance value of the first inductor L1 is set large enough to increase the recovering rate of the ineffectual energy when discharging the display panel, and the inductance value of the second inductor L2 is set small so as to reduce the rising time of a driving wave when charging the display panel.

In the third embodiment of the present invention, a fifth switch S5 may be connected between the first node N1 and the power supply Vsus like the first embodiment of the present invention.

A first diode D1 may be connected between the fifth node N5 and the second node N2. A second diode D2 may be connected between the second node N2 and the third switch S3. A third diode D3 may be connected between the first switch S1 and the fourth node N4. A fourth diode may be connected between the power supply Vsus and the first node N1.

The first, third, and fourth diodes D1, D3 and D4 pass a current flow from the first capacitor Cs to the display panel, and the second diode D2 passes a current flow from the display device to the first capacitor Cs.

Also, the first capacitor, the fourth switch, and one end of the display panel are grounded.

A method for operating the third embodiment of the present invention is the same as that of the first embodiment except for the construction of the periods (a) and (c) of FIG. 5B.

Therefore, an explanation on the method for operating the third embodiment will be omitted.

As described above, in the energy recovery circuit of the present invention, the first and second capacitors Cs and Cp are respectively charged with the half of the sustain voltage (Vs/2) and the voltage Vs/2 of the first capacitor Cs and the voltage Vs/2 of the second capacitor Cp are added up, thereby making the sustain voltage Vs when charging the display panel. The sustain voltage Vs is provided to the display panel.

Fourth Embodiment

Figure 6A:
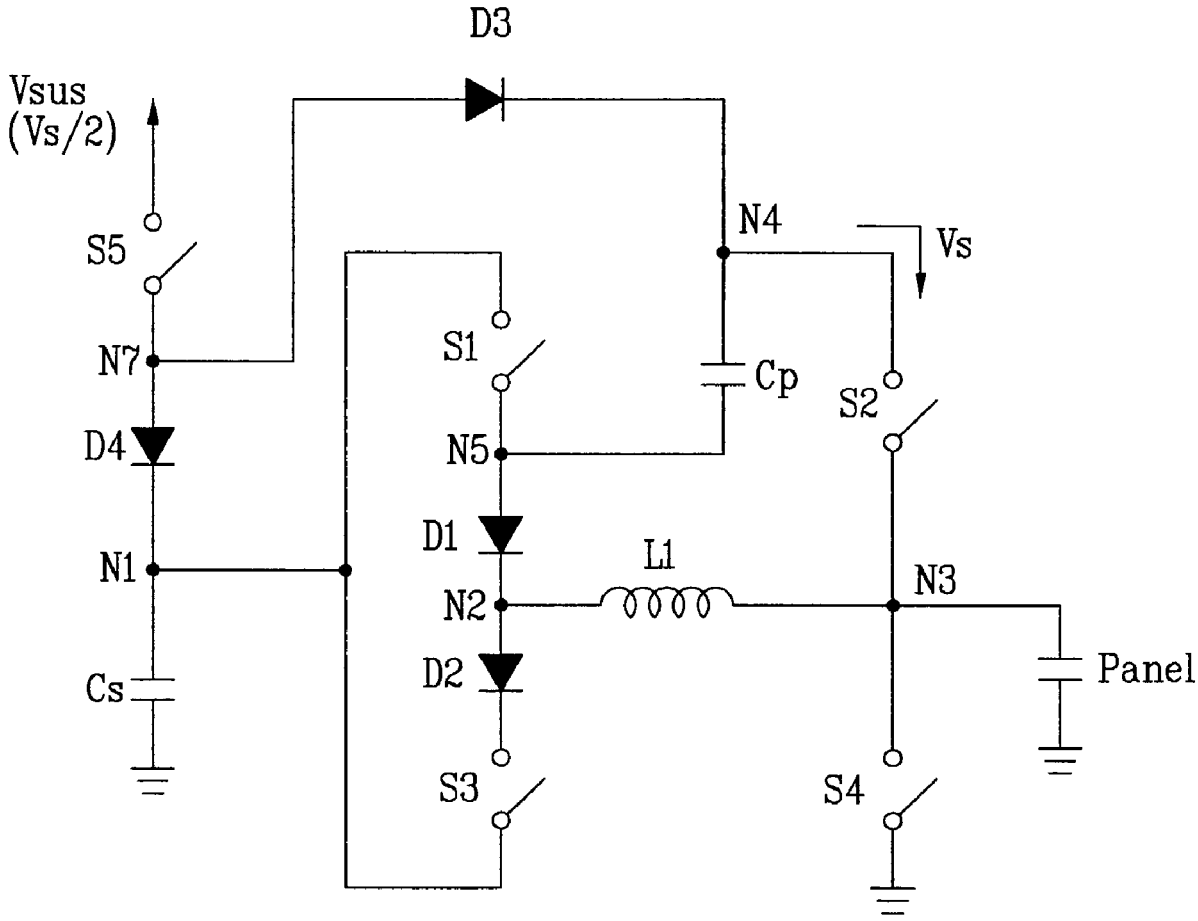
FIG. 6A is a circuit diagram illustrating an energy recovery circuit in accordance with the fourth embodiment of the present invention.
Figure 6B:
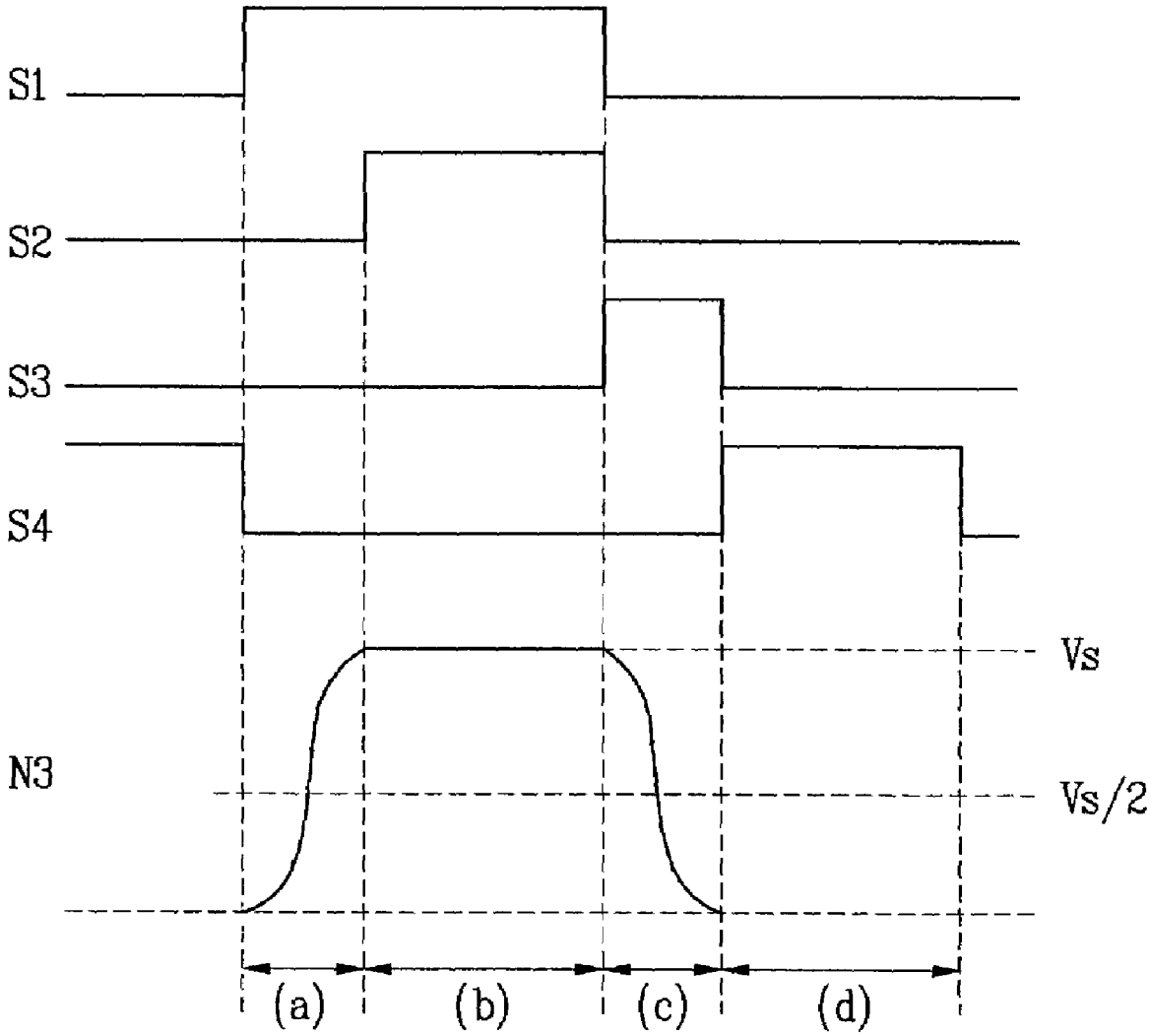
FIG. 6B is a driving waveform illustrating the energy recovery circuit of FIG. 6A.

FIG. 6A is a circuit diagram illustrating an energy recovery circuit in accordance with the fourth embodiment of the present invention. FIG. 6B is a driving waveform of the energy recovery circuit of FIG. 6A.

The composition of the fourth embodiment is the same as that of the first embodiment except for the disposition of the third diode D3.

In the fourth embodiment of the present invention, the third diode D3 may be connected between the fourth node N4 and the seventh node N7 (between the fourth diode D4 and the fifth switch S5).

A method for operating the fourth embodiment of the present invention is the same as that of the first embodiment.

Therefore, an explanation on the method for operating the fourth embodiment will be omitted.

Fifth Embodiment

Figure 7A:
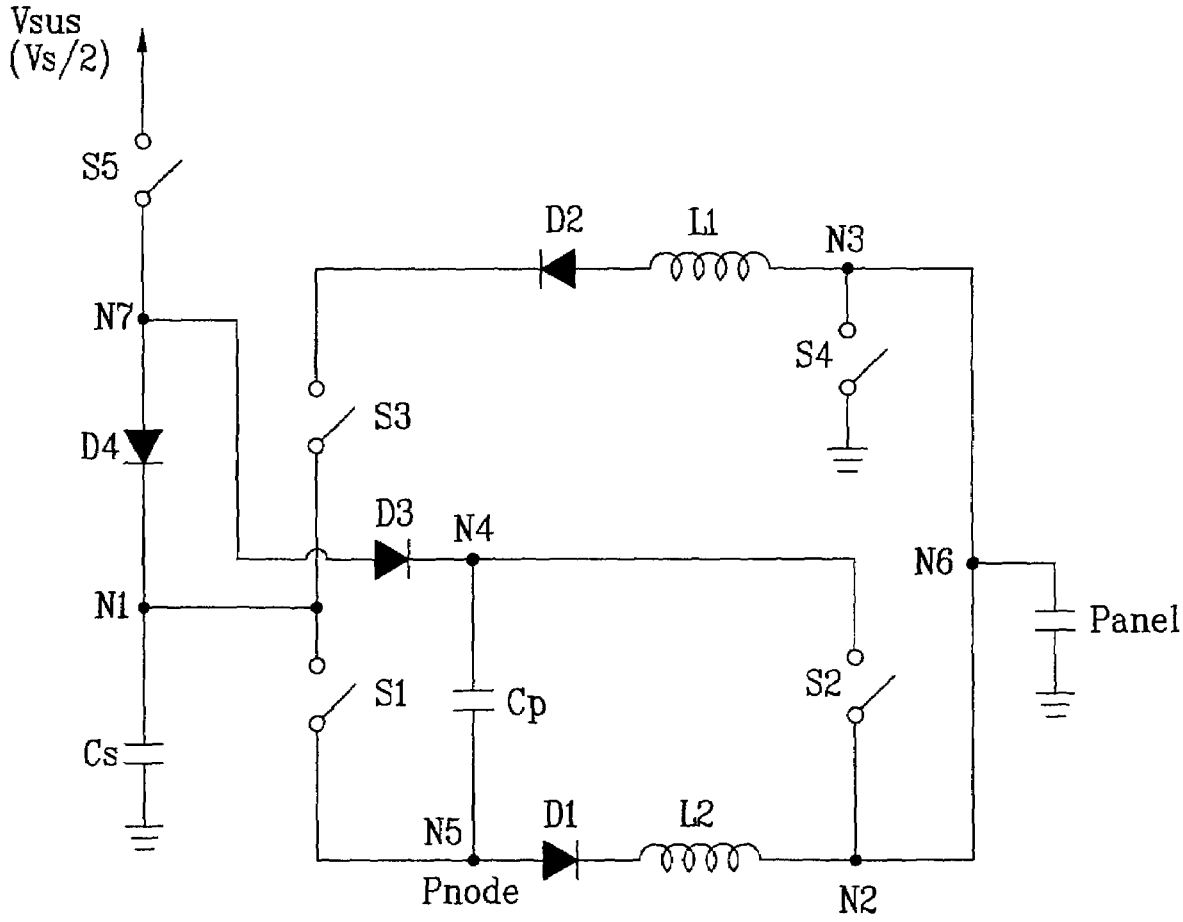
FIG. 7A is a circuit diagram illustrating an energy recovery circuit in accordance with the fifth embodiment of the present invention.
Figure 7B:
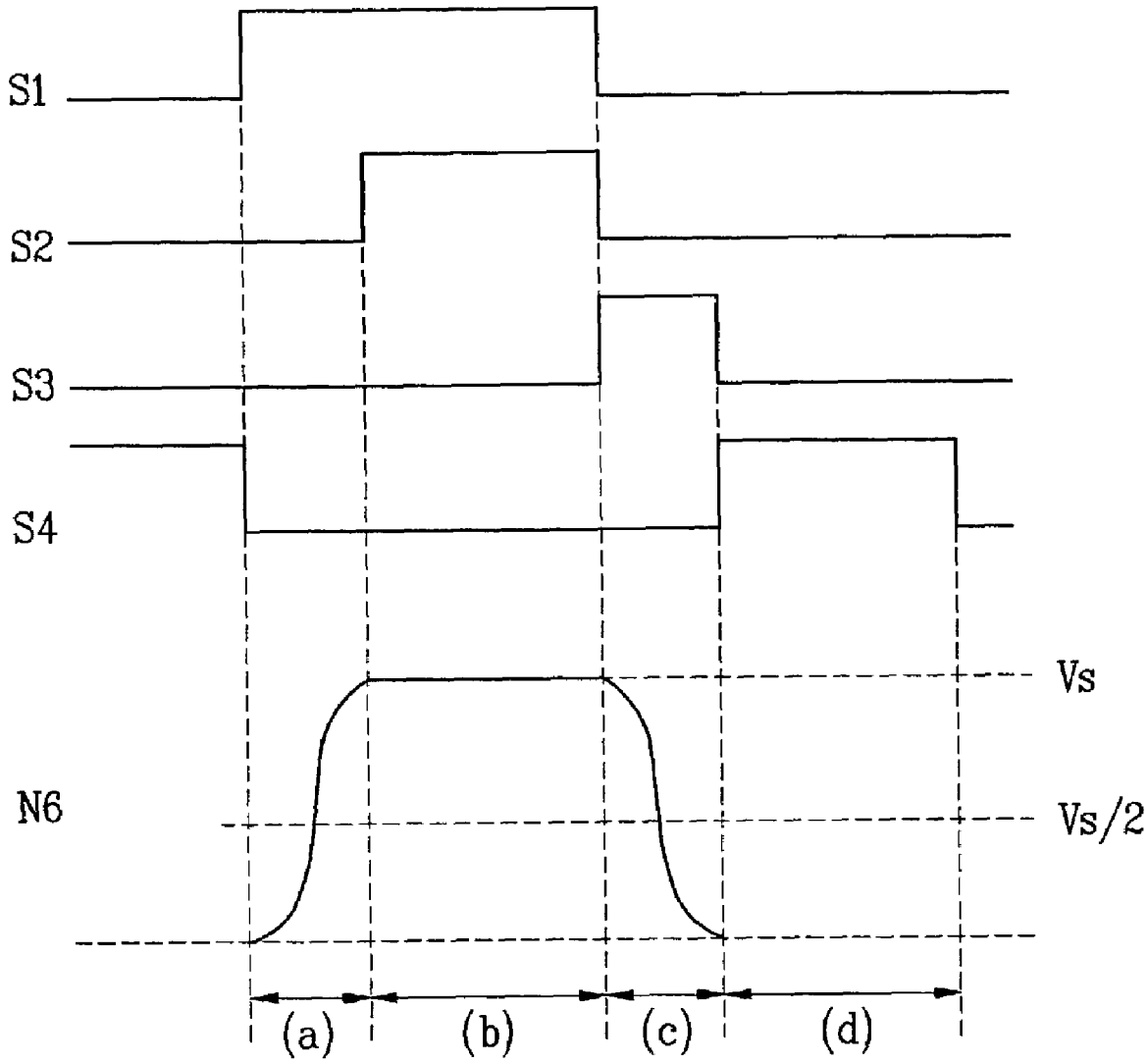
FIG. 7B is a driving waveform illustrating the energy recovery circuit of FIG. 7A.

FIG. 7A is a circuit diagram illustrating an energy recovery circuit in accordance with the fifth embodiment of the present invention. FIG. 7B is a driving waveform of the energy recovery circuit of FIG. 7A.

The composition of the fifth embodiment is the same as that of the third embodiment except for the disposition of the third diode D3.

In the fifth embodiment of the present invention, the third diode D3 may be connected between the forth node N4 and the seventh node N7 (between the forth diode D4 and the fifth switch S5).

A method for operating the fifth embodiment of the present invention is the same as that of the third embodiment.

Therefore, an explanation on the method for operating the fifth embodiment will be omitted.

Accordingly, in the energy recovery circuit of the present invention, the sustain voltage is reduced to a half of that of the prior art energy recovery circuit and thus power consumption decreases. Also, the sustain voltage is provided in a stable condition during a discharge maintaining period by using added voltage, thereby stabilizing a driving wave.

Also, because the sustain voltage is reduced to half in the energy recovery circuit of the present invention compared to the prior art, an internal voltage of the switch devices are reduced from 200 V to 100 V. Thus a switch device for the low voltage use can be applied, which has a cost-saving effect.

Even though an energy recovery circuit has been described taking a PDP as an example here, the energy recovery circuit of the present invention can be applied to any flat display device or other electric/electronic circuits in which a high voltage is needed and an ineffectual voltage occurs.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An energy recovery circuit of a display device, which provides a driving voltage to a display panel, the energy recovery circuit comprising:

a first capacitor for charging a voltage of ½ sustain voltage recovered from the display panel;

a switch circuit connected between the first capacitor and the display panel, the switch circuit having a plurality of switches for switching current flows when charging/discharging the first capacitor and the display panel, and having a single inductor serially connected to the display panel to form an LC resonance circuit;

a second capacitor connected between the switches of the switch circuit, for discharging its charged voltage of ½ sustain voltage to a first end of the display panel along with the voltage discharged from the first capacitor to the first end of the display panel when charging the display panel; and a power supply for providing a voltage to the first and second capacitors, wherein the switch circuit includes:

the first and third switches connected to the first capacitor in parallel, and also connected to each other serially, the second capacitor connected to the first switch in parallel, the inductor connected to at least one of the first and third switches, and second and fourth switches connected to a node between the display panel and the inductor.

2. The energy recovery circuit of claim 1, further comprising at least one of a diode and a switch device connected between the first capacitor and the power supply.

3. The energy recovery circuit of claim 1, further comprising at least one inductor connected between the switches of the switch circuit.

4. The energy recovery circuit of claim 1, wherein the first capacitor, the fourth switch, and the display panel are grounded.

5. The energy recovery circuit of claim 1, wherein the inductor is directly connected to the first end of the display panel without having any intervening device in an electrical path between the inductor and the first end of the display panel.

6. The energy recovery circuit of claim 1, wherein a second end of the display panel is grounded and without being charged by the energy recovery circuit when charging the display panel.

7. The energy recovery circuit of claim 1, wherein the single inductor is the only inductor in the switch circuit.

8. An energy recovery circuit of a display device, which provides a driving voltage to a display panel, the energy recovery circuit comprising:

a power supply for providing a voltage;

a first capacitor which is connected to the power supply and charges a voltage recovered from the display panel;

a first switch which is connected to a first node between the power supply and the first capacitor and switches a voltage provided from the first capacitor to the display panel;

a third switch which is connected to the first switch and the first node and switches a voltage provided from the display panel to the first capacitor;

an inductor which is connected between the display panel and a second node to form an LC resonance circuit, the second node disposed between the first and third switches;

a second switch which is connected between the first switch and a third node between the display panel and the inductor and switches the voltage provided from the first capacitor to the display panel;

a second capacitor which is connected between a fourth node between the first switch and the second switch and a fifth node between the first switch and the inductor and provides a voltage to the display panel along with the voltage discharged from the first capacitor when charging the display panel; and a fourth switch which is connected to the third node and switches the voltage discharged from the display panel.

9. The energy recovery circuit of claim 8, wherein the power supply provides a voltage to the first and second capacitors when discharging the display panel.

10. The energy recovery circuit of claim 8, wherein the voltage respectively charged in each of the first and second capacitors is a half of the voltage charged in the display panel.

11. The energy recovery circuit of claim 8, further comprising a fifth switch connected between the first node and the power supply.

12. The energy recovery circuit of claim 11, wherein the fifth switch is turned on/off when the fourth switch is turned on/off.

13. The energy recovery circuit of claim 8, wherein the second switch is turned on after a predetermined time since the first switch is turned on, and is turned off when the first switch is turned off, the third switch being turned on when the second switch is turned off, the fourth switch being turned on when the third switch is turned off.

14. The energy recovery circuit of claim 8, further comprising:

a first diode connected between the fifth and second nodes;

a second diode connected between the second node and third switch;

a third diode connected between the first switch and the fourth node; and a fourth diode connected between the power supply and the first node.

15. The energy recovery circuit of claim 14, wherein the first, third, and fourth diodes pass a current flow from the first capacitor to the display panel, and the second diode passes a current flow from the display device to the first capacitor.

16. The energy recovery circuit of claim 14, wherein the third diode is connected between the power supply and the fourth node.

17. The energy recovery circuit of claim 8, wherein the first capacitor, the fourth switch, and the display panel are grounded.

18. The energy recovery circuit of claim 8, further comprising a sixth switch with one end connected to the second capacitor and the other end grounded.

19. The energy recovery circuit of claim 18, wherein the sixth switch is turned on/off when the fourth switch is turned on/off.

20. An energy recovery device for a display panel, the device comprising:

a power supply to supply a half of a sustain voltage;

first and second capacitors each charged with the half of the sustain voltage;

a single inductor serially connected to the display panel to form an LC resonance circuit; and first and third switches connected to the first capacitor in parallel, and also connected to each other serially, the second capacitor connected to the first switch in parallel, the inductor connected to at least one of the first and third switches, and second and fourth switches connected to a node between the display panel and the inductors, the second switch to be turned on to supply a sum of the voltages charged in the first and second capacitors to a first end of the display.

21. The energy recovery device of claim 20, wherein the third switch is turned on to discharge a voltage from the display panel to the first capacitor.

22. The energy recovery device of claim 20, wherein the power supply is a single power supply.

23. The energy recovery circuit of claim 20, wherein the inductor is directly connected to the first end of the display panel without having any intervening device in an electrical path between the inductor and the first end of the display panel.

24. The energy recovery circuit of claim 20, wherein a second end of the display panel is grounded and without being charged by the energy recovery circuit when charging the display panel.

25. The energy recovery circuit of claim 20, wherein the single inductor is the only inductor in the switch circuit.

* * * * *